United States Patent [19]

Lientz

[11] 4,338,868

[45] Jul. 13, 1982

[54] REFUSE BURNING PROCESS AND APPARATUS

[76] Inventor: la Clede Lientz, P.O. Box 430, Branson, Mo. 65616

[21] Appl. No.: 231,163

[22] Filed: Feb. 3, 1981

[51] Int. Cl.[3] ..... F23G 5/06

[52] U.S. Cl. ..... 110/246; 432/115; 432/242

[58] Field of Search ..... 432/103, 115, 242; 110/211, 235, 246; 277/153

[56] References Cited

U.S. PATENT DOCUMENTS

| | | | |
|---|---|---|---|
| 2,104,040 | 1/1938 | Hurt . | |
| 2,659,588 | 11/1953 | Blanchard | 432/115 |
| 3,383,115 | 5/1968 | Eckley et al. | 432/115 |
| 3,794,565 | 2/1974 | Bielski et al. . | |
| 3,838,015 | 9/1974 | Buchbinder et al. . | |
| 3,842,762 | 10/1974 | Sargent et al. . | |
| 3,882,801 | 5/1975 | Bolle . | |
| 4,037,543 | 7/1977 | Angelo . | |
| 4,050,389 | 9/1977 | von Dreusche, Jr. | 110/190 |
| 4,092,098 | 5/1978 | Honaker et al. . | |
| 4,111,439 | 9/1978 | Schmidt | 432/115 |
| 4,182,246 | 1/1980 | Lombana et al. | 110/188 |
| 4,274,344 | 6/1981 | Nider | 110/246 |

*Primary Examiner*—Henry C. Yuen
*Attorney, Agent, or Firm*—Fishburn, Gold & Litman

[57] ABSTRACT

A process is provided for burning refuse containing polyvinyl chloride without the consequent production of phosgene. The refuse is carbonized in a rotary furnace at temperatures below 1200° F., especially 700° F., in an oxygen deficient atmosphere. A burnable gas containing the carbonized refuse is drawn from the furnace by an air jet wherein same is mixed with oxygen and selectively combusted. Uncarbonized refuse is collected and withdrawn after exiting the furnace. An apparatus is provided for combustion of the refuse in the nonphosgene generating process and includes the rotary furnace. Special seals are provided for the furnace to prevent excess oxygen from entering thereinto. In particular, the seals are utilized between the rotary ends of the furnace and stationary head associated with each end respectively. Each seal includes an upper and lower flap of fire resistant material secured to an end of the furnace and a companion flap of like material is secured to an associated end of the stationary head such that the intermediate flap sealably slides between the upper and lower flaps during rotation of the furnace thereby substantially sealing between the furnace and the stationary head.

11 Claims, 9 Drawing Figures

REFUSE BURNING PROCESS AND APPARATUS

BACKGROUND OF THE INVENTION

The present invention relates to a process and apparatus for combusting refuse, and especially to a process for burning of waste material including polyvinyl chloride or similar plastics which may produce phosgene upon combusting at certain temperatures without so producing such phosgenes.

Public landfills are rapidly overflowing with residential and commercial waste products. Trash disposal has become a serious problem, and many cities, municipalities, corporations or other entities which may have a need to dispose of trash, are looking to alternative means of disposing of such trash. One potential source of such disposal is by combustion of a large percentage of the trash. Such combustion produces substantial quantities of heat which may be beneficially used and may produce other byproducts such as fertilizer. Certain other portions of the trash may be also recovered for beneficial use, for example, metal components. In typical residential and commercial waste, as much as 5000 Btu of heat energy is recoverable from each pound of such waste. The volume of the waste may also be reduced as much as 90% to 95% in a combusting process.

A major problem related to the burning of commercial and industrial waste is the unwanted production of phosgene gas. Phosgene normally results from the burning of certain plastics, in particular, polyvinyl chloride (PVC) at temperatures above 1200° F. (Fahrenheit) or greater in the presence of excess oxygen. Such PVC is present in essentially all trash which is normally dumped in landfills in the form of plastic bottles, plastic trashbags or the like. Phosgene is a pollutant gas which may be hazardous to health of people or animals living near the discharge of such gas. Therefore, the emission of this gas is regulated by pollution control laws. Conventional trash burning processes typically produce substantial amounts of phosgene and require special reforming equipment through which the gasses exiting such conventional processes must be passed so as to convert the phosgene to a nonhazardous substance. Such reforming processes are typically quite expensive to operate which has substantially dampened the demand for trash burning processes.

It has been found that in order to control the amount of phosgene produced by a process burning PVC, it is necessary to carefully control the temperature and the amount of oxygen allowed to enter the process burning the trash until such trash has been fully carbonized. After carbonization of the trash, wherein a gas having a high Btu content is formed, such gas when subsequently burned, is less likely to form phosgene and may be removed from the process and burnt in the presence of excess oxygen. In order to control the temperature and the amount of oxygen present during the carbonization step, it is necessary to carefully control the amount of oxygen entering into the burning chamber. While a rotary kiln or furnace has been utilized in the past and is highly effective in burning trash, it is difficult to fully regulate the amount of oxygen entering into the burning chamber, especially as there are typically wide gaps between the ends of the rotary portion of the furnace and stationary heads associated with those ends. Because of the high temperatures associated with the furnaces and the continual wear thereon, previous seals at the juncture of the rotary portion of the furnace and the stationary heads have typically been ineffective. It is further noted that suitable seals must be provided whereat trash enters the process and whereat noncombusted trash and gasses exit the process.

It has further been found that furnaces including refracted tiles typically are difficult to control temperature wise and also that in some instances additional cooling must be added as a jacket or the like to maintain temperatures within the furnace below phosgene producing temperatures.

OBJECTS OF THE INVENTION

Therefore, the objects of the present invention are: to provide a process and apparatus for combusting refuse containing PVC without substantial production of phosgene; to provide such a process wherein the refuse is combusted within a temperature and oxygen controlled atmosphere within a furnace; to provide such a process wherein combustion gasses from carbonization of refuse within the controlled atmosphere is removed therefrom and burnt in an excess of oxygen to produce energy in the form of heat; to provide such a process wherein noncombustible compounds in the refuse are separated from combustion gas and recovered for beneficial use thereof; to provide such a process utilizing an air jet to urge the combustion gasses from the furnace; to provide such a process wherein various seals are utilized to control access of oxygen to a combustion chamber of the furnace; to provide such an apparatus including a furnace having a rotating central portion and stationary head portions; to provide such a furnace which is sealed between the central rotary portion and stationary heads thereof by upper and lower flaps attached to the rotary portion of the furnace by banding or the like and an intermediate flap which sealably engages and slides between the upper and lower flaps and is attached by banding or the like to the stationary portion of the furnace; to provide such an apparatus including plug type augers for transferring refuse into the furnace and removing noncombusted refuse from the furnace in such a manner as to restrict oxygen flow into an interior portion of the furnace; to provide such a method and apparatus which produces substantially little phosgene from the combustion of refuse containing PVC; to provide such an apparatus which is economical to manufacture and operate, durable in use, and which is particularly well adapted for the intended usage thereof.

Other objects and advantages of this invention will become apparent from the following description taken in connection with the accompanying drawings wherein are set forth by way of illustration and example, certain embodiments of this invention.

SUMMARY OF THE INVENTION

An apparatus is provided for combusting refuse containing PVC and other organic chlorides without substantial production of phosgene. The apparatus comprises a refuse burning furnace, delivery means for transferring refuse to the furnace, oxygen control means for restricting flow of oxygen into the furnace, first removal means for transferring noncombusted refuse from the furnace, and second removal means for transferring gasses from the furnace. The oxygen control means limits the amount of oxygen which may enter the furnace and thereby controls the amount of combustion occurring therein and consequently, the temperature within the furnace.

In particular, the delivery means comprises a hog or hammermill or other suitable device for crushing and comminuting large pieces of trash, such as glass or cans, before the trash is fed to the furnace. The trash is conveyed from the hammermill to a gate or feed mechanism which allows the refuse to enter the furnace but substantially prevents oxygen from entering thereinto. The gate mechanism may be of an air gate type, rotary gate type or a driven auger which forms a refuse plug at the end thereof to prevent oxygen from entering into the furnace. It is foreseen that other types of gate or feeding devices may be utilized to feed refuse but prevent or substantially restrict oxygen from entering thereinto.

The furnace may be substantially any enclosure which will withstand the heat produced during burning. A furnace of the tumble or rotary type is preferred. This furnace includes a central rotating section and stationary heads or dome sections at opposite ends thereof. Normally, the rotary portion of the furnace will be driven by a motor connected to the furnace by suitable drive chain and the furnace will ride upon bearings of a well known type. Typically, there is a substantial gap in such furnaces between the rotary section and each of the head sections. Control means are provided to prevent substantial amounts of oxygen from entering the furnace through these gaps.

In particular, a seal is formed at the juncture of the rotating section and each of the head sections of the furnace. Each seal preferably comprises three generally flat and heat resistant strips which encircle the furnace. Preferably, the straps are of a woven asbestos cloth or the like and are suitably pliable, yet slidable relative to one another. The straps include a upper and lower strap which are tightly secured to either the rotating section or the head section by banding or the like so as to have distal ends which extend in the direction of the opposite section. An intermediate strip is attached to the opposite section also by banding or the like so as to have a distal end which extends between the upper and lower straps so as to engage therewith. As the furnace rotates, the upper and lower straps slide relative to the intermediate strap but form a seal therewith. It is foreseen that additional straps could also be utilized in this same manner in an overlying fashion. It is noted that when the furnace has a slight vacuum therein, the straps are pulled into tight relationship with one another so as to better seal against entry of oxygen at such times.

The furnace also includes a supplemental and a pilot burner for igniting the refuse therein and/or for use if the temperature within the furnace gets too low. Preferably, the pilot burner is located substantially near the point of entry of the refuse into the furnace and vertically spaced below such point of entry. The burners may combust gas, oil or the like and have an oxygen supply control associated therewith which preferably provides only sufficient oxygen to burn the media used in that burner. The pilot light is normally continuous and aids in preventing explosions and ensuring that the supplemental burner fuel and the refuse will always ignite. Also preferably, a means is provided for supplying oxygen to the furnace in a controlled manner. This may be accomplished by an air blower or use of compressed oxygen with suitable control mechanisms to ensure that the added oxygen enters the furnace in a controlled manner. In particular, the oxygen supply may have a control valve associated therewith which is operated by a thermocouple positioned within the furnace to limit the amount of oxygen entering thereinto and thereby control the temperature of the furnace. As a substantial amount of phosgene is produced when the temperature of the furnace having PVC therein reaches approximately 1200° F. to 1300° F., it is desired to never allow the furnace to exceed 1100° F. In particular, the temperature of the furnace, as controlled by the amount of oxygen flowing thereinto, is preferably maintained in a range from 300° F. to 900° F., and especially, about 700° F. The temperature may be varied up and down somewhat dependent upon the content of the refuse being burnt within the furnace. Some refuse requires slow burning at lower temperatures, while other refuse may be burnt near a higher end of this range. The temperature within this range may also be somewhat controlled by the amount of other pollutants released during combustion in the apparatus.

Also preferably, the furnace is not lined with refractory tile which is common in kilns and other rotary furnaces. It is found that the refractory tile tends to keep too much heat within the furnace and restrict flow of refuse thereinto since such flow must be slowed to allow for heat to escape from the furnace. It is envisioned that in some installations, a cooling jacket on the furnace may be necessary where high flow rates of refuse into the furnace are necessary. Water heated in the cooling jacket to form steam may be beneficially used to drive a turbine or for heating or the like. The furnace also preferably includes flighting on the interior thereof which tends to agitate the refuse, lift the refuse so as to place it in better contact with the flame from the pilot burner, and to transfer noncombustible refuse along the furnace to an end opposite whereat the refuse enters thereinto.

The furnace includes an outlet normally opposite the inlet whereat refuse is delivered to the furnace having located therebetween, a carbonizing or burning chamber. Associated in close proximity to the furnace outlet is a fallout chamber having a cross-sectional area normal to the flow of components exiting the furnace which is substantially greater than the cross-sectional area of the furnace normal to a longitudinal axis thereof, such that there is a velocity decrease of gasses as they exit the furnace and enter the fallout chamber. The decrease in velocity of the gasses in the fallout chamber tends to urge particulate material therein to fall to the bottom of the fallout chamber thereby removing a substantial portion of such particulate matter from the gasses. Removal means are provided to transfer the particulate matter collected at the bottom of the fallout chamber, along with any noncombustible refuse which has been urged from the furnace, exterior of the apparatus without allowing a substantial amount of oxygen to enter into the furnace. Preferably, an auger is provided to remove this particulate matter and noncombusted refuse. The auger is controlled such that there is always a plug in the discharge end thereof so as to prevent oxygen from flowing back through. The material so conveyed by the auger is controlled in bins, drums or the like for future separation and/or use. In particular metals within such collected material may be recovered by known methods of separation and by use of magnets. It has been found that the collected material from burnt residential and commercial waste, mostly ash, is exceptionally high in fertilizer value and therefor may be utilized for this purpose.

The combustion of the refuse within the furnace carbonizes the refuse producing a gas which is relatively high in Btu content which can be easily burnt. It has been found that burning under controlled conditions, as described herein, utilizes approximately 1/5 to 1/6 of the Btu content of the refuse. The remaining 4/5 to 5/6 of the Btu content thereof generally passes with the gas from the furnace and through the dropout chamber.

The gas produced within the furnace is drawn therefrom by the second removal means which preferably, comprises a mixer means and vacuum producer such as an air jet of the type which will inject air through a venturi tube so as to pull a slight vacuum upon the furnace and draw gas from the furnace through the air jet. In this manner, the air jet ensures that oxygen will not substantially flow back into the furnace, but rather a slight vacuum will normally be pulled on the furnace. For instance, at some times the vacuum would be in the nature of ½ to 20 millimeters of mercury vacuum, although higher ranges are possible. The air jet may be selectively provided with a flame to ignite the gas in the presence of the oxygen utilized in the venturi tube to draw the gas from the furnace. For instance, natural gas may be injected with the oxygen to form a combustible mixture which may be ignited by a pilot flame. It is also foreseen that other possible devices could be utilized to draw the gas from the furnace. In particular, a fan or compressor may be utilized for this purpose. The compressor may be especially useful in a situation where it is desired to store the gas for later use.

Where it is desired to burn the gas immediately, for its heat value or simply to waste the gas, the gas is allowed to burn at the exit of the air jet in a suitable burner. If the gas is wasted, a heat waster comprising a large open-top tank may be utilized, or alternatively, the gas may be passed through a heat exchanger to heat water. Where it is desired to utilize the heat content contained within the gas, the water may be contained in a boiler or the like to produce steam which is thereafter utilized for heating, driving a turbine or the like.

Alternatively, the gas exiting the furnace may be mixed with steam in the presence of a nickel catalyst in a suitable chamber and thereby form a liquid fuel which may be stored and later utilized. Also, alternatively, the gas could be burnt in and thereby drive a jet engine which would be operably connected to an electrical generator so as to produce electricity therefrom.

A process is provided herein where refuse including PVC is conveyed to an enclosed chamber or furnace in an atmosphere to which oxygen supply is substantially controlled at a temperature less than 1100° F., especially with the range of 300° to 900° F. and preferably 700° F. Gas is produced by this burning and normally has a carbon content within a range of about 60% to 80% by weight. This gas is withdrawn from the chamber. The gas may be burned immediately in an air jet or the like or stored for future use. In a particular embodiment, the gas is mixed with excess oxygen and burnt to produce heat energy which is thereafter collected and beneficially utilized. Normally, the refuse will require ignition and in some situations may require a continuous secondary source of flame to burn at a satisfactory rate. This is particularly true where there is a substantial amount of moisture in the refuse. It may also be desirable to ignite or add additional heat by a supplementary burner when the temperature within the furnace becomes too low such that carbonization of the refuse is progressing too slowly. In addition, when the temperature within the furnace is too low additional air may be fed, for instance, by a blower or the like into the furnace so as to increase combustion therein. It is foreseen that the present process could be utilize to reduce other toxic or unwanted gasses, besides PVC, generated from a burning process, if such gasses can be controlled by limiting the temperature and combustion of the material which is in turn controlled by limiting the available oxygen (as contained in air) for combustion. As a consequence of this process, it is required that there be an effective seal about the furnace and that oxygen supply to the furnace be fully controllable.

It is noted that recyclable metals are generally unaffected by the carbonization process within the burning chamber of the furnace. Such metals will exit from the furnace with carbonized materials and ash which normally varies in chemical analysis substantially according to the make-up of the feed material along with burning temperature and oxygen supply within the furnace. In many cases, the metals removed from the furnace will be recoverable by screening and magnetic separation processes which are well known in the art.

It is noted that the process described herein may be batch or continuous in type; however, the continuous type process is preferred. Also preferably, the apparatus utilized in the process is sized sufficiently to accomodate short term variations in the type and/or volume of the materials charged to the furnace without major upsets to the entire system. It is noted that generally any material that can be carbonized may be utilized in the process, even when containing a substantial quantity of water or the like. However, it is preferred not to charge volatile chemicals or other hazardous waste to the furnace, as same would have a tendancy to burn too hotly and/or produce unwanted or toxic gasses.

The drawings constitute a part of this specification and include exemplary embodiments of the present invention and illustrate various objects and features thereof.

DETAILED DESCRIPTION OF THE PREFERRED EMBODIMENT

Figure 1:
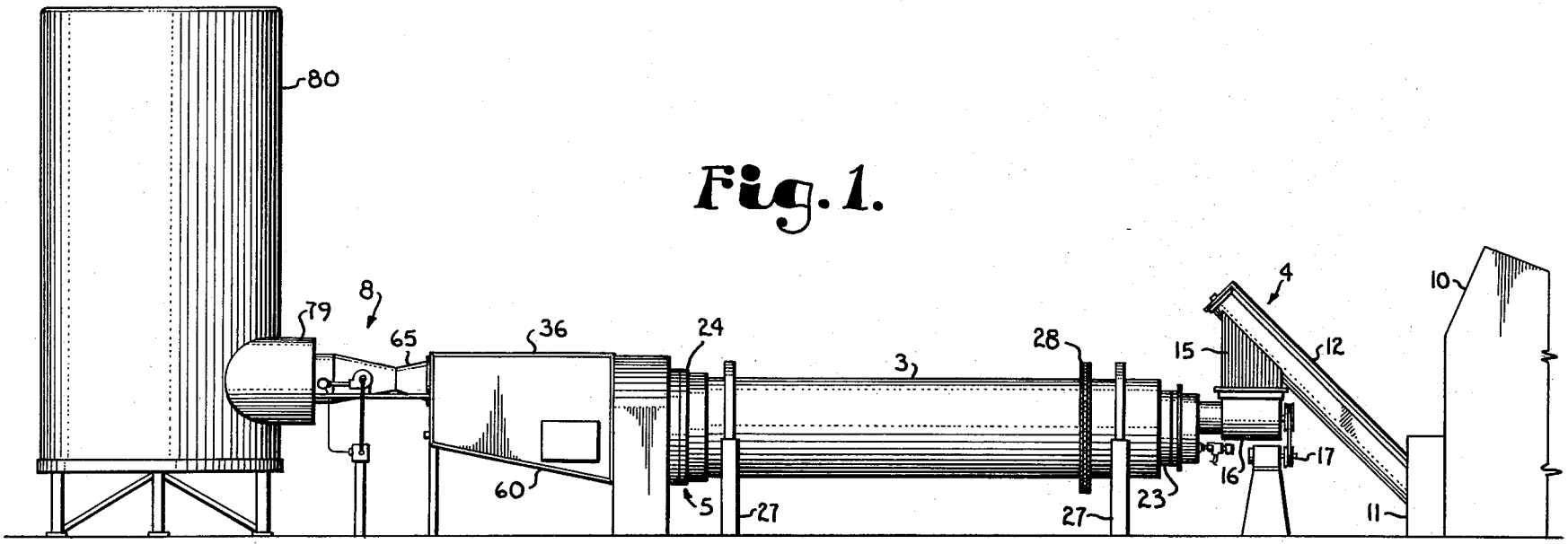
FIG. 1 is a side elevational view of a refuse burning apparatus according to the present invention.
Figure 2:
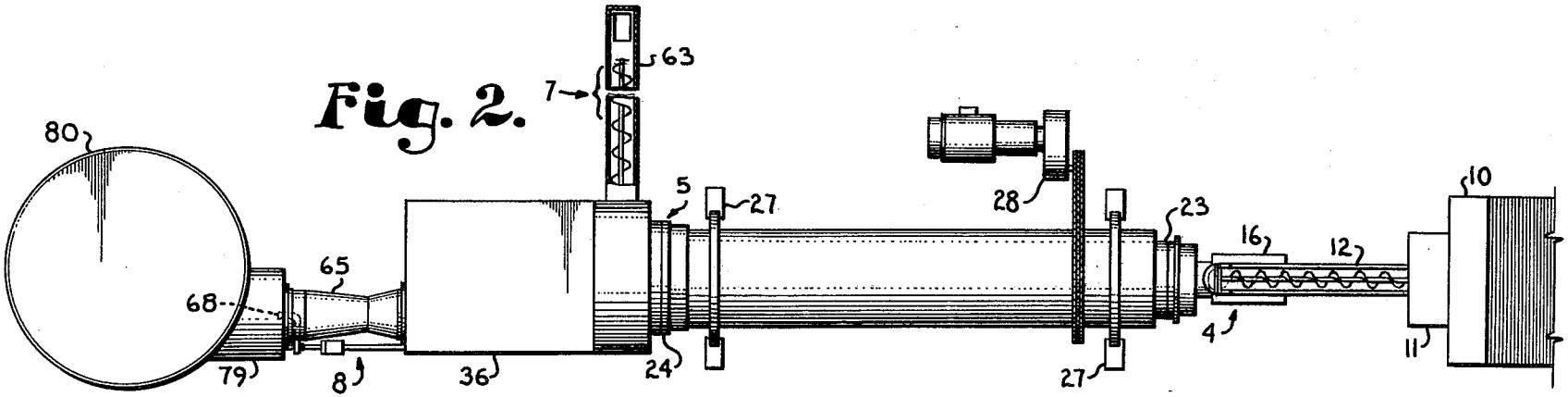
FIG. 2 is a top plan view of the apparatus with portions broken away to show details thereof.
Figure 3:
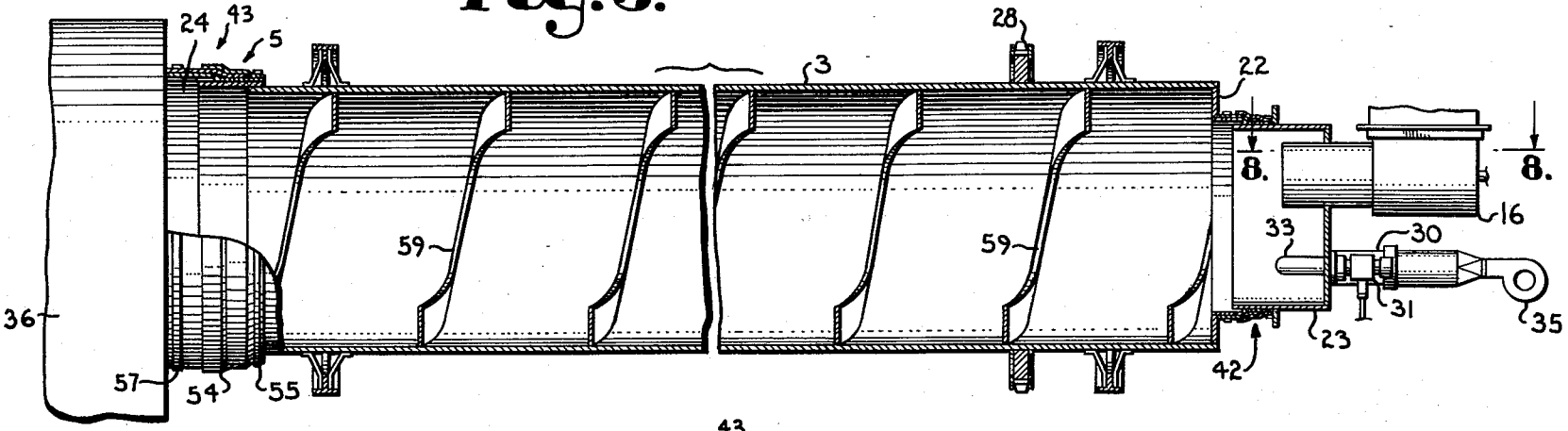
FIG. 3 is a fragmentary and enlarged side elevational view of the apparatus showing a furnace associated therewith with portions broken away to show detail thereof.
Figure 4:
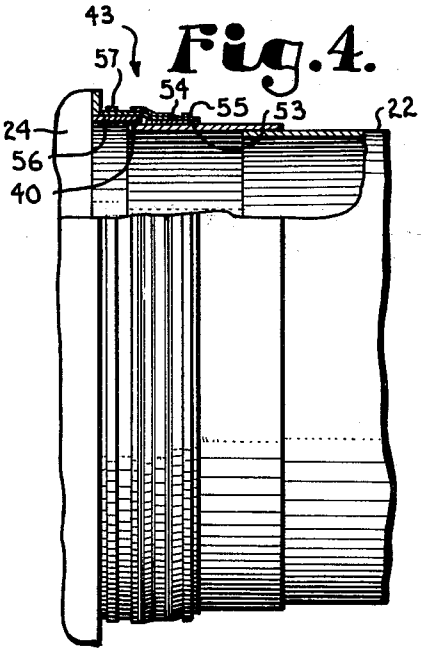
FIG. 4 is a fragmentary and enlarged view of a first end of the furnace showing a seal associated therewith with portions broken away to show detail thereof.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriate detailed structure.

The reference numeral 1 generally represents a refuse or trash burning apparatus according to the present invention. The apparatus 1 comprises a carbonization chamber or furnace 3, delivery means 4 for delivering refuse to the furnace, control means 5 for restricting flow of oxygen into the furnace 3, first removal means 7 for conveying noncombustible portions of the refuse from the apparatus 1, and second removal means 8 for conveying gasses from the furnace 3.

The delivery means 4 includes an intermediate shelter 10 for refuse brought to the site of the apparatus 1. Refuse from the shelter 10 is shoveled, augered or the like into a hog or hammermill 11 wherein large pieces of the refuse are collapsed and comminuted and thereafter, the hammermill treated refuse is conveyed by an auger elevator 12 to a top thereof. From the elevator 12, the refuse is deposited within a chute 15 whereupon it falls into a feed auger 16 driven by a suitable motor and pulley arrangement 17. The feed auger 16 includes a blade 19 which generally only has bearings at the motor end thereof, the opposite end being allowed to free wheel within the casing of the auger 16. The auger 16 extends into the furnace 3 and is suited for building a plug of refuse (now shown) therein so as to prevent oxygen flow from entering the furnace 3 through such auger.

Figure 8:
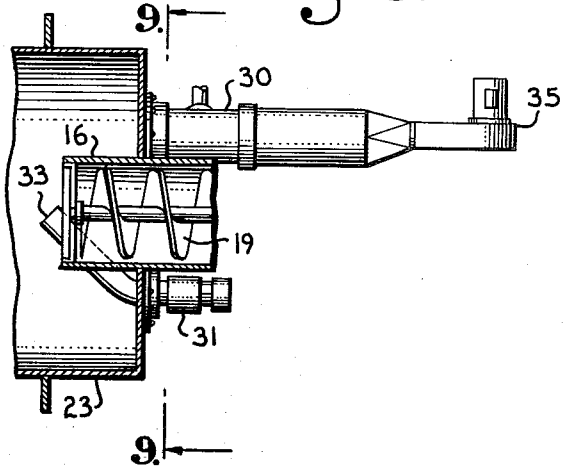
FIG. 8 is a fragmentary and enlarged cross-sectional view of the apparatus taken along line 8—8 of FIG. 3.
Figure 9:
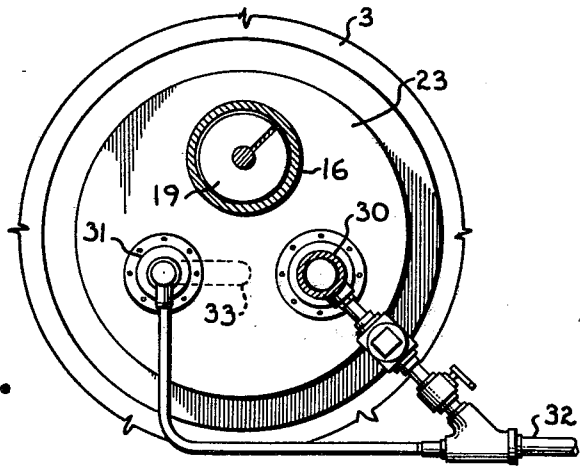
FIG. 9 is a fragmentary and enlarged cross-sectional view of the apparatus taken along line 9—9 of FIG. 8.

The furnace 3 is of a rotary or tumbling type having a rotating middle section 22 and opposed head or end sections 23 and 24 being located near the feed end and exit end of the furnace 3 respectively. The furnace middle section 22 rests upon vertical pillars 27 having suitable rotation bearings thereon and is rotated by a drive belt and motor 28 attached by suitable gearing to the middle section 22. With reference to FIGS. 8 and 9, the furnace head section 23 has attached to an end thereof, so as to communicate with the furnace 3, a supplemental burner 30 and a pilot burner 31. The supplemental burner 30 is fed from a gas line 32 through suitable valving. The supplemental burner 30 may be manually operated, or alternatively, controlled by a thermocouple or the like so as to maintain a preselected minimum temperature within the furance 3. The pilot burner 31 preferably burns continuously and is also fed by the conduit 32. The pilot burner 31 has a discharge nozzle 33, shown in phantom in FIGS. 8 and 9. The burner 31 extends such that the nozzle 33 generally is spaced vertically below the auger 16 and generally horizontally aligned with the auger 16 such that refuse exiting the auger will fall by gravity through a flame extending from the nozzle 33 and be ignited thereby. As seen in FIG. 8, the supplemental burner 30 includes a blower 35 which supplies oxygen to such supplemental burner in generaly stoichiometric quantities for burning of the gas being burnt by such burner. It is also possible for the blower 35 to be utilized to add additional oxygen to the furnace 3 when necessary to raise the temperature therein for faster burning. The furnace exit end head 24 is sealably secured to a fallout chamber 36 which will be discussed below.

Figure 5:
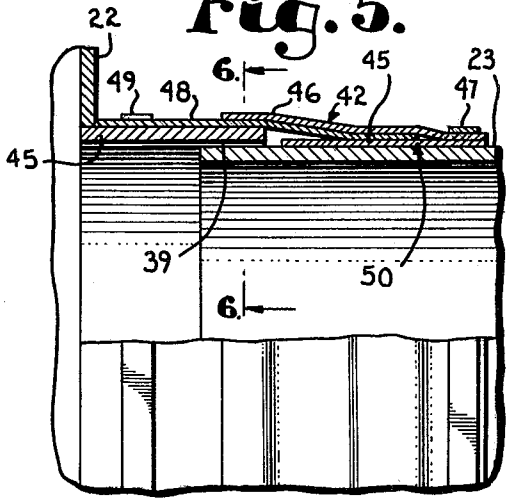
FIG. 5 is a fragmentary and enlarged side elevational view of the furnace showing a seal associated with a second end thereof with portion broken away to show detail thereof.
Figure 6:
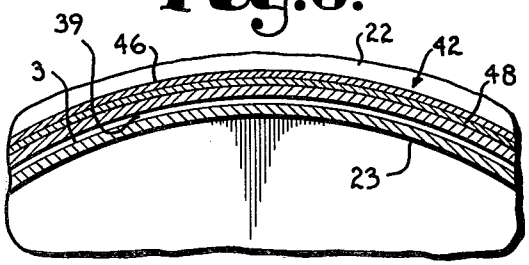
FIG. 6 is a cross-sectional view of the furnace second end and seal associated therewith taken along line 6—6 of FIG. 5.

The furnace middle section 22 is slightly overlapped and spaced from the heads 23 and 24 thereby forming a gap 39 and 40 therebetween respectively. Control means 5 such as seals 42 and 43 for gaps 39 and 40 respectively prevent excess oxygen from entering the furnace 3 through the gaps 39 and 40. The seal 42, as shown in FIGS. 5 and 6, comprises a lower and upper strap or flat member 45 and 46 respectively which generally encircle the head 23 and are positioned in overlaying relationship. The straps 45 and 46 are secured at an end thereof opposite the furnace 3 by a band 47 to the head 23 leaving opposite ends of the straps free. An intermediate strap 48 is secured by band 49 to an end of the furnace middle section 22 so as to extend between the upper strap 46 and lower strap 45 opposite therefrom. The straps 45, 46 and 48 are made of a somewhat pliable yet slidable material which will withstand heat from the furnace 3 and resist wear from rotation of the furnace middle section 22 with the head 23. Preferably, the straps are of a woven fabric or an asbestos sheet, such as is commercially sold under the trade designation Mannville asbestos tape. It is is noted that in the illustrated embodiment, the upper strap extends over the end of the furnace middle section 22. The straps 45, 46 and 48 cooperate together to prevent oxygen from entering into the furnace through the gap 39. There is also a tendency for the strap 48 to become tighter against the strap 45, generally in proportion to the strength of any vacuum within the furnace 3, so as to add additional sealing protection against entry of oxygen in proportion to the amount of vacuum in the furnace 3.

The seal 43 at the opposite end of the furnace from the seal 42 is essentially the same construction as such opposite seal except that lower and upper straps 53 and 54 respectively are bound to the furnace middle section 22, whereas an intermediate strap 56 is bound by a band 57 to the head 24. The interior of the first middle section 22 includes flighting 59 therearound which functions to agitate the refuse and to convey noncombusible refuse or carbonized refuse toward the fallout chamber 36.

The fallout chamber 36 has a substantially larger cross-sectional area in a plane perpendicular to an axis of the furnace 3 as compared to the cross-sectional area of the furnace 3 perpendicular to such an axis. In general, the fallout chamber provides for a decrease in velocity in gasses exiting the furnace so as to urge particulate matter to settle onto a bottom 60 thereof. The first removing means 7, illustrated here as an auger 63, transfers settled particulate matter and noncombusted refuse which has exited the furnace 3 from the apparatus 1. The material transferred by the auger 63 may be conveyed to a storage bin, drums, or the like which are not shown. Preferably, the auger 63 maintains a plug of material in a discharge thereof so as to prevent oxygen from entering through the auger 63 into the furnace 3. The fallout chamber bottom 60 is sloped toward the auger 63 so as to facilitate movement of particulate matter settled thereon into such auger.

Figure 7:
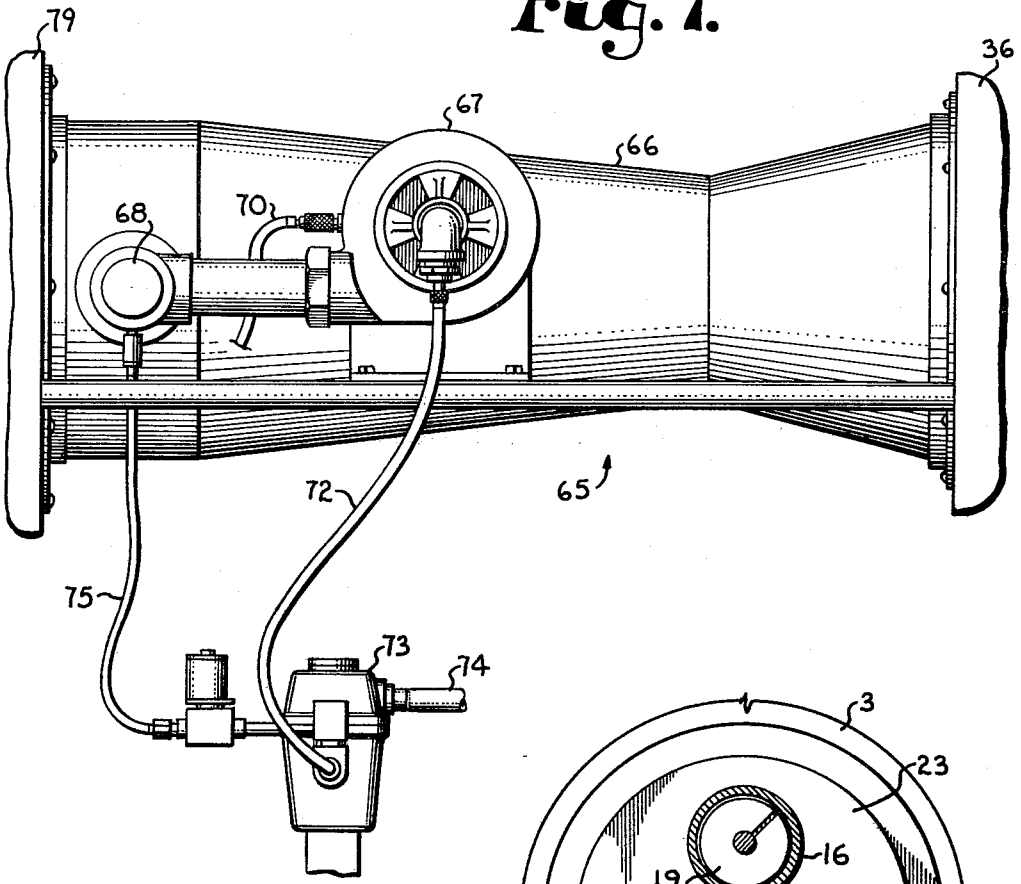
FIG. 7 is a fragmentary and enlarged side elevational view of the apparatus showing an air jet associated therewith.

Gasses are removed from the furnace 3 through the fallout chamber 36 by the second removal means 8 which is illustrated herein as an air jet 65. This air jet 65 also functions as a mixing means for mixing the gasses with air. As is best seen in FIG. 7, the air jet 65 includes a venturi tube 66 which has a downstream side thereof attached to and flow communicating with the interior of the fallout chamber 36. An air blower 67 is utilized to compress air into a relatively high velocity stream which is directed through a distribution nozzle 68 into an interior of the air jet 65 downstream of the venturi tube 66. The blower 67 is operated by a compressed air stream which is supplied thereto by conduit 70 from a suitable source such as an air compressor or the like (not shown). During certain modes of operation of the apparatus 1, it may be desirable to burn the gasses coming from the furnace 3. At such times natural gas or the like may be injected into the air through natural gas conduit 72 which is controlled by a regulator 73 which in turn is supplied with natural gas by conduit 74. A secondary gas conduit 75 is supplied to open interior of the air jet 65 near the distribution nozzle 68 to function as a pilot light when gas is added to the blower 67.

The gaseous stream exiting the air jet 65, whether ignited and burnt with natural gas injected by the blower 67 and pilot conduit 75, or not, enters a burning chamber 79 wherein the gas, if ignited, is free to burn in an excess of oxygen. Thereafter, the gas enters a heat waster 80 comprising a large cylindrical tank. The heat waster 80 may also function as a heat exchanger for boiling water or a feed to a turbine or the like operated by burning and expanding gasses.

In operation, refuse is placed in the hammermill 11 whereat it is broken into relatively small pieces and thereafter conveyed by elevator 12 and auger 16 to the inlet of the furnace 3. In the furnace 3, the pilot 31 ignites the refuse. The furnace 3 is maintained in an oxygen deficient state as compared to having sufficient oxygen to completely combust the refuse such that the temperature therein does not exceed 1100° F. and preferably, is in the nature of 700° F. throughout. Control of oxygen entering the furnace is accomplished by ensuring that the delivery auger 16, discharge auger 63, and air jet 65 do not allow oxygen to backflow through into the furnace 3. But more importantly, the seals 42 and 43 between each end of the furnace middle section 22 and heads 23 and 24 substantially prevent oxygen from entering into the furnace 3 in an uncontrolled manner. Additional oxygen can and sometimes is required for proper burning of the refuse within the furnace 3, and this is accomplished by manual or automatic control of the blower 35 with or without assistance from the supplementary gas burner 30. The furnace 3 is rotated and a substantial portion of the combustible material therein is carbonized and a gas, heavy in carbon content, is produced. A portion of the Btu content of the refuse is used in carbonizing same, however, a substantial quantity of the Btu heat content remains in the gas produced within the furnace 3. The gas is withdrawn from the furnace 3 by means of a slight vacuum placed thereon by the air jet 65. As gas passes through the fallout chamber 36, particulate matter tends to settle to the floor of the fallout chamber 36 and is thereby separated from the gas for conveyance away by the auger 63. An air jet 65 may be utilized only to draw the gas from the furnace 3 or alternatively may be used in conjunction with natural gas which is ignited so as to burn the gas coming from the furnace 3 in an excess of oxygen and thereby effect substantially complete combustion of all combustable portions of the refuse.

It is to be understood that while certain embodiments of the present invention have been described and shown herein, it is not to be limited to specific forms or arrangement of parts herein described and shown.

What is claimed and desired to be secured by Letters Patent is as follows:

1. An apparatus for burning refuse having polyvinyl chloride therein comprising:

(a) a rotary furnace having a rotating middle section and stationary heads at opposite ends of said middle section;

(b) first delivery means for transmitting refuse to said furnace; said first delivery means being adapted to restrict flow of oxygen through said delivery means into said furnace;

(c) second delivery means for conveying non-combusted refuse from said apparatus; said second delivery means being adapted to prevent flow of oxygen through said second delivery means to said furnace;

(d) a sealing mechanism between said furnace middle section and each of said heads respectively; each of said sealing mechanisms comprising a lower, an intermediate and an upper strap; said lower and upper straps being secured in overlapping manner to a first of said middle section or an associated head; said intermediate strap being secured to a second of said middle section or the associated head; said intermediate strap being flexible and slideably positioned between said upper and lower straps and sealably engaged therewith such that when said middle section is rotating with respect to said associated head, oxygen is substantially restricted from passing therebetween;

(e) whereby oxygen flow to said furnace can be controlled when the refuse is being combusted therein such that the temperature in said furnace is adapted to be controlled below about 1200 degrees F. so that phosgene is not produced by the burning of the polyvinyl chlorides in the refuse.

2. The apparatus according to claim 1 wherein:

(a) each of said straps is secured to said furnace by respective bands encircling said furnace; and (b) each of said straps is constructed of an asbestos cloth.

3. The apparatus according to claim 1 wherein:

(a) said intermediate strap includes a distal end which extends over and is supported by the middle section or head opposite to the head or middle section to which said intermediate strap is secured; and (b) said intermediate strap is sufficiently flexible to bend outwardly from said furnace and is prevented from bending toward said furnace by the support provided by the opposite middle section of head.

4. The apparatus according to claim 2 wherein for each sealing mechanism:

(a) said lower strap is bound to and extends entirely around the edge of one end of said middle section;

(b) said intermediate strap is bound to the associated head and has a distal end extending over said lower strap; and (c) said upper strap is flexible and bound in overlapping relationship to said lower strap; said upper strap having a distal end extending over and engaging said intermediate strap and extending over the associated head.

5. The apparatus according to claim 1 or 4 wherein:

(a) said flow conducting means has associated therewith a device for urging gas from said furnace.

6. The apparatus according to claim 5 wherein:

(a) said flow conducting means further includes an air jet comprising a venturi and an air blower for mixing excess air with gases withdrawn from said furnace.

7. An apparatus for burning refuse having polyvinyl chloride therein comprising:

(a) a rotary furnace having a rotating middle section and stationary heads at opposite ends of said middle section;

(b) a sealing mechanism between said furnace middle section and each of said heads respectively; each of said sealing mechanisms comprising:

(1) a first flexible strap bound to said middle section and encircling an associated end of said middle section; said first strap having a distal end extending over an associated head and is supported thereby;

(2) a second flexible strap bound to the associated head and encircling an end of the associated head mating with said middle section; said second strap having a distal end extending over the middle section and is supported thereby;

(3 ) said first and second straps being in overlapping and engaging relationship so as to substantially form a seal against air entering said furnace between the middle section and the associated head;

(c) first delivery means for transmitting refuse to said furnace; said first auger delivery means being adapted to restrict flow of oxygen through said first delivery means into said furnace;

(d) a second delivery means for conveying noncombusted refuse from said apparatus; said second delivery means being adapted to restrict flow of oxygen through said second delivery means to said furnace; and (e) conducting means for urging gas formed in said furnace by combustion of said refuse from said furnace.

8. The apparatus according to claim 1 including:

(a) a third strap encircling said middle section in underlying relationship to said second strap;

(b) said second strap being secured to said middle section and said first strap being secured to an associated head; and (c) said first strap distal end being slideably positioned and sealing between a portion of said second and third straps.

9. The apparatus according to claim 7 wherein:

(a) said conducting means further includes a venturi tube and a blower for urging air through said venturi tube such that the gas in said furnace is urged through said conducting means and excess air is mixed with the gas for combustion therein.

10. An apparatus for burning refuse having polyvinyl chloride therein comprising:

(a) a rotary furnace having a rotating middle section and stationary heads at opposite ends of said middle section;

(b) a mill for comminuting the refuse;

(c) a first auger for transmitting comminuted refuse to said furnace; said first auger being adapted for forming a plug of said refuse therein so as to restrict flow of oxygen through said first auger into said furnace;

(d) a second auger for conveying noncombusted refuse from said apparatus; said second auger being adapted for forming a plug of said noncombusted refuse therein so as to prevent flow of oxygen through said second auger to said furnace;

(e) an air jet for urging gas formed in said furnace by combustion of said refuse from said furnace; said air jet being adapted for mixing said gas with an excess of oxygen and igniting said mixed gas and oxygen for substantially complete combustion of said mixed gas;

(f) a fallout chamber between said furnace and said air jet and having a cross-sectional area substantially larger than the cross-sectional area of said furnace perpendicular to a longitudinal axis of said furnace, such that gas passing through said chamber has a lower velocity as compared to gas in said furnace; whereby particulate material in said gas is urged to settle to the bottom of said chamber; and (g) a sealing mechanism between said furnace middle section and each of said heads; each of said sealing mechanisms comprising a lower, an intermediate and an upper strap; said lower and upper straps being secured in overlapping manner to a first of said middle section or an associated one of said heads; said intermediate strap being secured to a second of said middle section or said associated head; said intermediate strap being slideably positioned between said upper and lower straps and sealably engaged therewith such that when said middle section is rotating with respect to said associated head, oxygen is substantially restricted from passing therebetween;

(h) whereby oxygen flow to said furnace can be controlled when the refuse is being combusted therein such that the temperature in said furnace is adapted to be controlled below about 1200° F. so that phosgene is not produced by the burning of the polyvinyl chlorides in the refuse.

11. An apparatus for burning refuse having polyvinyl chloride therein comprising:

(a) a rotary furnace having a rotating middle section and stationary heads at opposite ends of said middle section;

(b) a sealing mechanism between said furnace middle section and each of said heads; each of said sealing mechanisms comprising:

(1) a flexible flap of heat resistant material securely attached to one of said furnace middle section or an associated head;

(2) said flap having a distal end extending over the opposite of said middle section or associated head, such that said flap slides along and is supported by said opposite middle section or associated head in engaging fashion and seals between said middle section and said associated head;

(c) first delivery means for transmitting refuse to said furnace; said first delivery means being adapted to restrict flow of oxygen through said first delivery means into said furnace;

(d) a second delivery means for conveying noncombusted solid refuse from said apparatus; said second delivery means being adapted to restrict flow of oxygen through said second delivery means to said furnace; and (e) an air jet means for urging gas formed in said furnace by combustion of said refuse from said furnace; said air jet means being adapted for mixing said gas with an excess of oxygen and igniting said mixed gas and oxygen for substantially complete combustion of said gas;

(f) said air jet means urges gas from said furnace in conjunction with said sealing mechanisms substantially restricting flow of oxygen between said middle section and each of said heads; said sealing mechanism flaps being flexible away from said furnace to allow excess pressure to escape from said furnace;

(g) whereby oxygen flow to said refuse is controlled to maintain furnace temperature below about 1200 degrees F. to prevent production of phosgene from burning polyvinyl chloride, combustion gases within said furnace are normally withdrawn by said air jet means to prevent escape from the furnace to surrounding atmosphere, and during an overpressure state within said furnace gases can escape past said flaps.

* * * * *